United States Patent [19]

Maxson et al.

[11] Patent Number: 4,808,879

[45] Date of Patent: Feb. 28, 1989

[54] POST-DEFLECTION ACCELERATION AND SCAN EXPANSION ELECTRON LENS SYSTEM

[75] Inventors: Scott A. Maxson; John H. Sonneborn, both of Portland, Oreg.

[73] Assignee: Tektronix, Inc., Beaverton, Oreg.

[21] Appl. No.: 58,725

[22] Filed: Jun. 5, 1987

[51] Int. Cl.[4] ..... H01J 29/70

[52] U.S. Cl. ..... 313/421; 313/429; 313/434

[58] Field of Search ..... 313/421, 429, 432, 434, 313/439, 449, 458, 460

[56] References Cited

U.S. PATENT DOCUMENTS

| | | | |
|---|---|---|---|
| 2,103,645 | 12/1937 | Schlesinger | 313/434 |
| 4,507,586 | 3/1985 | Correll | 315/3 |
| 4,623,819 | 11/1985 | Janko et al. | 313/432 |
| 4,752,714 | 6/1988 | Sonneborn et al. | 313/429 |

FOREIGN PATENT DOCUMENTS

| | | | |
|---|---|---|---|
| 216343 | 12/1983 | Japan | 313/432 |

*Primary Examiner*—David K. Moore
*Assistant Examiner*—K. Wieder
*Attorney, Agent, or Firm*—John D. Winkelman; Paul S. Angello; Mark M. Meininger

[57] ABSTRACT

An acceleration and scan expansion lens system for use in an electron discharge tube provides scan expanion in which the amount of scan expansion provided in the horizontal direction is independent of the amount of scan expansion provided in the vertical direction. In a preferred embodiment, the lens system (10) is employed in a cathode-ray tube (12) which has greater deflection sensitivity in the vertical direction than in the horizontal direction. The lens system includes a mesh electrode structure (62) that has a dome-shaped mesh element (66) which is supported by an electrically connected to a metallic cylindrical support element (70). The dome-shaped mesh element is formed to have a concave surface as viewed in the propagation direction (35) of the electron beam and is of rotationally symmetric shape. The lens system also includes an annular electrode element (64) that has an aperture of elliptical shape and is positioned adjacent the output end of the mesh electrode structure. The major and minor axes (74 and 76) of the elliptical electrode element are aligned with the respective vertical and horizontal directions. A potential difference applied between the mesh electrode structure and the elliptical electrode element creates between them an electrostatic field which provides lensing action that is stronger in the horizontal direction than in the vertical direction. The difference between the lensing action in the horizontal and vertical directions is proportional to the relative lengths of the respective minor and major axes of the elliptical electrode element.

15 Claims, 5 Drawing Sheets

POST-DEFLECTION ACCELERATION AND SCAN EXPANSION ELECTRON LENS SYSTEM

TECHNICAL FIELD

The present invention relates to post-deflection electrostatic electron lens systems of the type used in electron discharge tubes and, in particular, to an acceleration and scan expansion lens the horizontal direction is independent of the amount of the scan expansion in the vertical direction.

BACKGROUND OF THE INVENTION

A post-deflection electrostatic acceleration and scan expansion electron lens system incorporated in, for example, a cathode-ray tube (CRT) typically performs two distinct functions. First, the lens system increases the angle of electron beam deflection produced by the deflection structures of the CRT to scan the beam over an area of a desired size on the display screen. Second, the lens system accelerates the beam electrons. The acceleration of the beam electrons is characterized as being of either positive or negative sign, with positive acceleration and negative acceleration indicating beam electron acceleration directed toward and away from, respectively, the display screen of the CRT. Positive acceleration increases the energy of the beam electrons and thereby produces a brighter image on the display screen. Negative acceleration repels low-energy and secondary emission electrons away from the display screen and thereby reduces the number of spurious light patterns present in the image.

One type of acceleration and scan expansion lens system makes use of a quadrupole lens of the Klemperer-type, which comprises a pair of adjacent, cylindrical electrode elements. A CRT employing such a lens system typically includes separate deflection structures for deflecting horizontally in the X-direction and vertically in the Y-direction an electron beam traveling toward a display screen in the Z-direction of a three-dimensional Cartesian coordinate system. The horizontal and vertical deflection structures typically have different lengths as measured in the Z-direction, are separated from the display screen by different amounts, and operate in response to signals provided by respective horizontal and vertical deflection signal amplifiers having different gain characteristics. These differences provide a CRT with different deflection sensitivities in the horizontal and vertical directions.

The quadrupole scan expansion lens converges and diverges the beam electrons in different ones of the X-Z and Y-Z planes. The particular planes of convergence and divergence are determined by the arrangement of, and the relative magnitudes of voltages applied to, the quadrupole lens electrodes. In the convergence plane of the quadrupole lens, scan expansion results from focusing the beam electrons to a point at a location near the lens and then allowing the beam to diverge from that point, thereby employing over-convergence to expand the scan of the electron beam. It is very difficult, therefore, to design a Klemperer-type quadrupole lens that would provide the preferred scan expansion in both the X-Z and Y-Z planes. As a consequence, such a lens typically matches the deflection sensitivities of the CRT in only one of the X-Z and Y-Z planes, thereby providing a beam image spot size that is optimized in only one of the X-Z and Y-Z planes.

A quadrupole lens converges and diverges beam electrons in different ones of the X-Z and Y-Z planes by generating substantial field variations over relatively short distances. As a consequence of these field variations, the scan expansion performance of a quadrupole lens is dramatically altered by slight variations in the positioning of the lens electrode elements. Such positioning variations would include, for example, those that occur during production-type manufacturing.

SUMMARY OF THE INVENTION

An object of this invention is, therefore, to provide a post-deflection electrostatic electron lens system that provides electron beam scan expansion that can be matched to the desired deflection sensitivities in both the horizontal and vertical deflection directions of a CRT.

Another object of this invention is to provide such a lens system that allows optimization of the beam image spot size in both the horizontal and vertical deflection directions.

A further object of this invention is to provide such a lens system that is relatively insensitive to slight variations in the positioning of its electrode elements.

The present invention is directed to an electrostatic acceleration and scan expansion lens system for use in an electron discharge tube such as, for example, a cathode-ray tube (CRT). The CRT includes an electron gun that produces a beam of electrons directed along a beam axis extending along the length of the tube. A pair of quadrupole lenses are positioned along the beam axis for focusing the beam. Deflection structures deflect the beam in the horizontal and vertical directions relative to the beam axis in response to signals received from a corresponding pair of deflection signal amplifiers. A third quadrupole lens is positioned between the horizontal and vertical deflection structures. The divergence plane of the third quadrupole lens is aligned with the vertical direction to increase the angle of vertical deflection. The vertical deflection structure is positioned upstream of the horizontal deflection structure to provide greater overall deflection sensitivity in the vertical direction than in the horizontal direction. The lens system of this invention is positioned downstream of the deflection structures to increase the horizontal and vertical deflection angles of the electron beam as it propagates toward the display screen of the CRT, thereby to scan the beam over an area of a desired size.

In a preferred embodiment, the lens system includes a mesh electrode structure that has a dome-shaped mesh element which is supported by and electrically connected to a metallic cylindrical support element. The dome-shaped mesh element is formed to have a concave surface as viewed in the propagation direction of the electron beam and is of rotationally symmetric shape. The lens system also includes a short length tubular electrode element that has an aperture of elliptical shape and is positioned adjacent the output end of the mesh electrode structure. The orientations and lengths of the major and minor axes of the elliptical electrode element are selected to provide the desired scan expansion in the horizontal and vertical directions.

An externally applied DC voltage source provides a potential difference between the mesh electrode structure and the elliptical electrode element, the mesh electrode structure receiving a voltage which is approximately equal to the average potential applied to the deflection structures and which is negative relative to the voltage received by the elliptical electrode element. The potential difference applied between, and the arrangement of, the mesh electrode structure and the elliptical electrode element create between them an electrostatic field which diverges the beam electrons in both the horizontal and vertical deflection directions. The lensing action is, however, stronger in the direction of horizontal deflection than in the direction of vertical deflection. As a result, the lens system provides greater scan expansion in the horizontal direction than in the vertical direction.

The lens system can be matched to substantially any desired deflection sensitivities in both the horizontal and vertical deflection directions. The lens system provides, therefore, an additional degree of freedom which in the design of a CRT can be used, for example, to optimize the beam image spot size in both the horizontal and vertical deflection directions. Since it is divergent in both the horizontal and vertical deflection directions, the lens system of this invention requires only a relatively weak lensing action to provide the required amount of scan expansion, thereby employing electric fields having relatively gentle variations. As a result, the lens system of this invention is relatively insensitive to small variations in the positioning of its electrode elements.

Additional objects and advantages of the present invention will be apparent from the following detailed description of preferred embodiments thereof, which proceeds with reference to the accompanying

DESCRIPTION OF PREFERRED EMBODIMENTS

Figure 1:
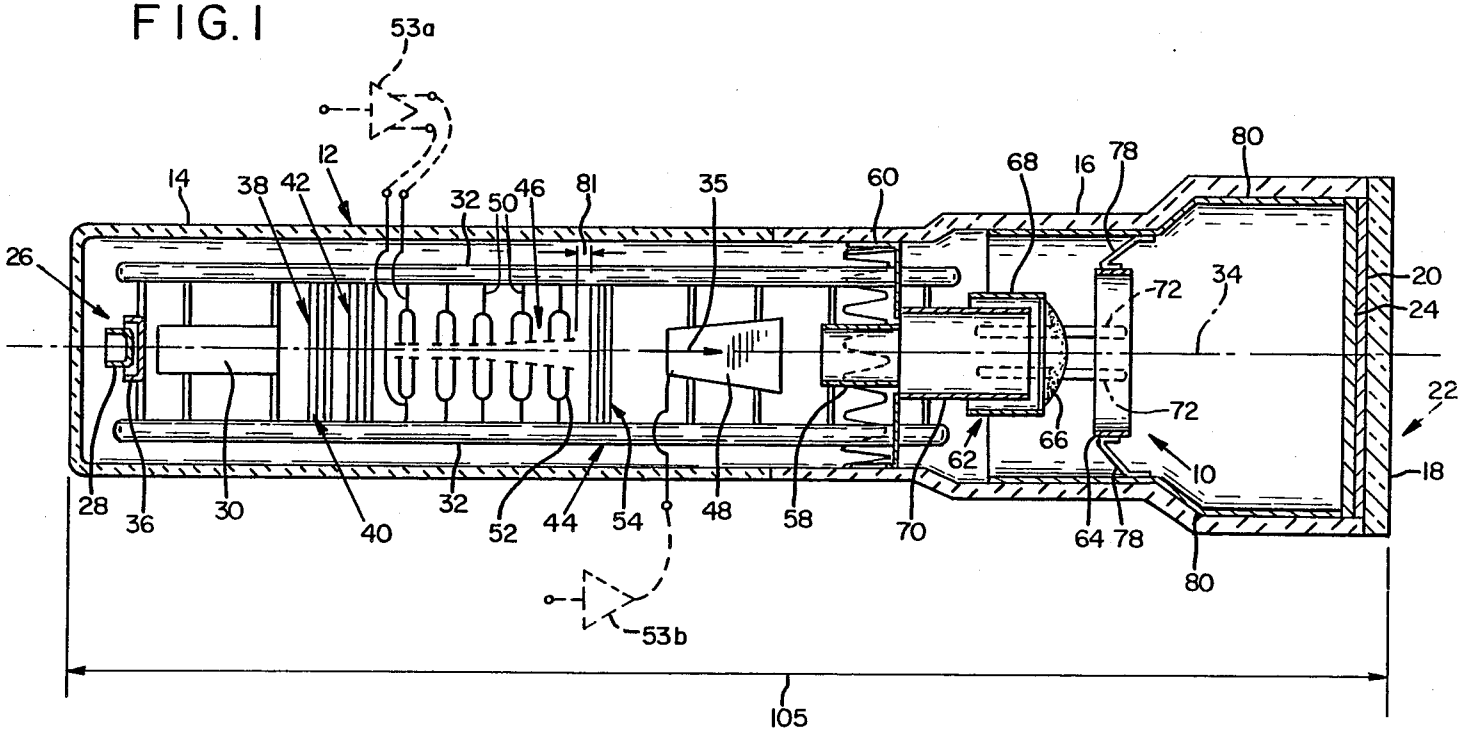
FIG. 1 is a schematic longitudinal sectional view of a CRT incorporating a first preferred embodiment of the post-deflection acceleration and scan expansion lens system of the present invention.

With reference to FIG. 1, an electron beam acceleration and scan expansion lens system 10 designed in accordance with the present invention is contained within the evacuated envelope of a cathode-ray tube (CRT) 12 adapted for use in an oscilloscope. The envelope includes a tubular glass neck 14, a ceramic funnel 16, and a transparent glass face plate 18 which are sealed together by devitrified glass seals as taught in U.S. Pat. No. 3,207,936 of Wilbanks, et al. A layer 20 of a phosphor material such as, for example, P-31 phosphor, is coated on the inner surface of face plate 18 to form the display screen 22 of CRT 12. An electron-transparent aluminum film 24 is deposited by evaporation on the inner surface of layer 20 of the phosphor material to provide a high-voltage electrode for display screen 22.

An electron gun 26, which includes a cathode or emitter 28 and an anode 30, is supported by glass rods 32 inside neck 14 at one end of CRT 12. Electron gun 26 produces a beam of electrons that propagate generally along a beam axis 34 in a direction 35 toward display screen 22, the beam axis 34 being coincident with the central longitudinal axis of CRT 12. A DC voltage source (not shown) applies to anode 30 and cathode 28 voltages of approximately 0 and −2 kilovolts, respectively, thereby accelerating toward anode 30 the electrons emitted from cathode 28. A beam current control grid 36 positioned between cathode 28 and anode 30 and biased to a voltage of between −2 and −2.1 kilovolts controls the amount of current carried by the electron beam.

A focusing and astigmatism adjusting lens 38 is positioned adjacent the output end of anode 30 and includes first and second quadrupole lenses 40 and 42, respectively. Astigmatism adjusting lens 38 is preferably of the type described in U.S. Pat. Nos. 4,137,479 and 4,188,563 of Janko (Janko patents). First quadrupole lens 40 converges the beam electrons in the X-Z plane and diverges the beam electrons in the Y-Z plane, and second quadrupole lens 42 diverges the beam electrons in the X-Z plane and converges the beam electrons in the Y-Z plane. The X, Y, and Z axes referred to above relate to the coordinate system defined in FIG. 2.

A deflection assembly 44 positioned adjacent the output end of second quadrupole lens 42 deflects the electron beam such that it strikes display screen 22 and forms a light image thereon. Deflection assembly 44 includes a vertical deflection structure 46, and a pair of horizontal deflection plates 48 (one shown). Deflection structure 46, which is preferably of the type described in U.S. Pat. No. 4,207,492 of Tomison, et al., provides vertical deflection of the electron beam in response to vertical deflection signals applied to its upper and lower members 50 and 52 by a vertical deflection signal amplifier **53*a*, which is shown in phantom. Deflection plates 48 deflect the beam in the horizontal direction in response to a horizontal deflection signal which is, typically, the ramp voltage output of a horizontal deflection signal amplifier 53*b***, which is shown in phantom.

Vertical deflection signal amplifier **53*a* amplifies signals of higher frequency than those amplified by horizontal deflection signal amplifier 53*b*. The electrical circuit design constraints associated with such higher operating frequencies result in amplifier 53*a* having a lower power output capability than that of amplifier 53*b*. As a consequence, the deflection signals generated by horizontal deflection signal amplifier 53b have greater voltage magnitudes and, therefore, provide greater deflection power than that of the deflection signals generated by vertical deflection signal amplifier 53a**.

A third quadrupole lens 54, which is preferably of the type disclosed in the Janko patents, is positioned between vertical deflection structure 46 and horizontal deflection plates 48. Quadrupole lens 54 is arranged to diverge the beam electrons in the Y-Z plane such that lens 54 provides an astigmatism adjustment and an increase in the vertical deflection angle. The increase in vertical deflection angle provided by quadrupole dens 54, together with the positioning and relative lengths of deflection structure 46 and deflection plates 48, provides an increase in the vertical deflection sensitivity which in the aggregate is greater than the difference between the power output capabilities of the deflection amplifiers. The design of CRT 12 provides, therefore, greater overall deflection sensitivity in the vertical direction than in the horizontal direction.

A cylinder element 58 having multiple spring supports 60 distributed around the periphery thereof is positioned between correction lens 56 and lens system 10. Cylinder element 58 provides a field-free region through which the deflected electron beam propagates. Spring supports 60 engage the interior surface of glass neck 14 to provide additional structural support for lens system 10.

Figure 2:
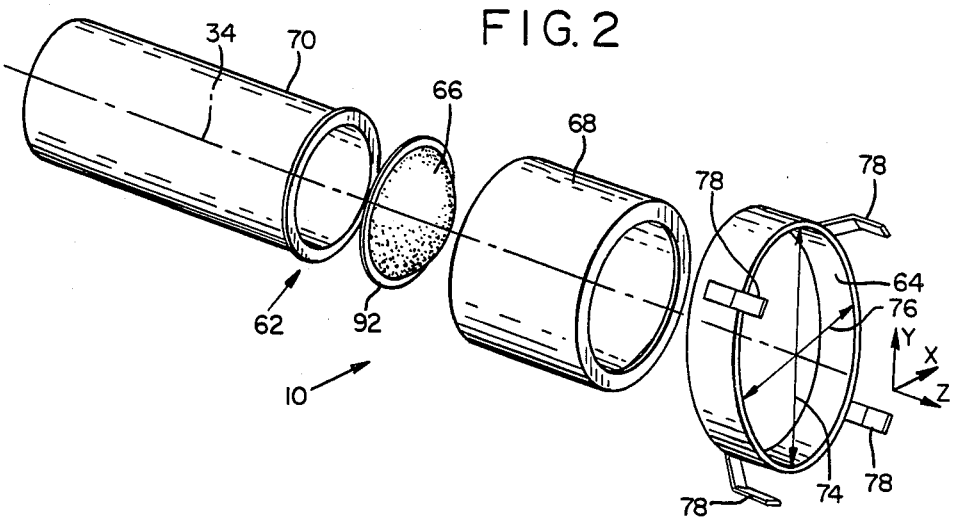
FIG. 2 is an exploded view showing the components of the lens system of FIG. 1.
Figure 3:
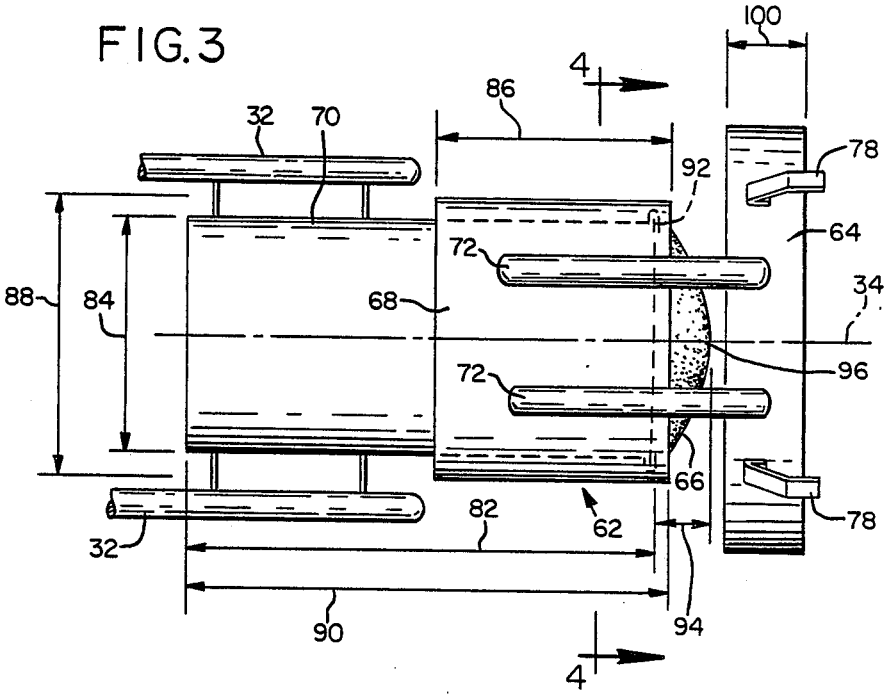
FIG. 3 is an enlarged side elevation view of the lens system of FIGS. 1 and 2.
Figure 4:
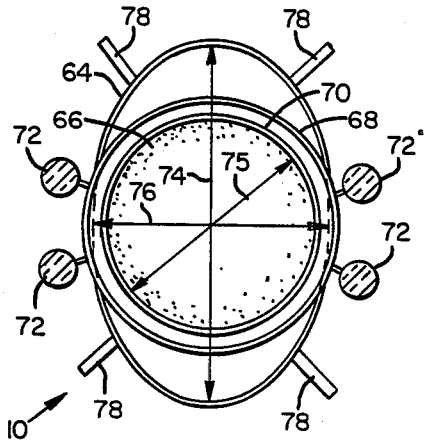
FIG. 4 is a vertical sectional view taken along lines 4—4 of FIG. 3.

With reference to FIGS. 2–4, a first preferred embodiment of acceleration and scan expansion lens system 10 comprises a mesh electrode structure 62 positioned adjacent a short length tubular electrode element 64. Mesh electrode structure 62 includes a dome-shaped mesh element 66 that is secured between a retaining ring 68 and the downstream end of a support cylinder 70. Support cylinder 70 is attached to and supported by glass rods 32. Retaining ring 68 overlaps a portion and is supported on the downstream end of support cylinder 70. Mesh element 66 is constructed of nickel and is formed in the shape of a rotationally symmetric concave surface as viewed in the propagation direction of the electron beam. Preferably, mesh element 66 is in the shape of a conic section of revolution.

Electrode element 64 is of elliptical cross section, as viewed in the X-Y plane, and is attached to glass rods 72, which are supported by retaining ring 68. Elliptical electrode element 64 has, therefore, an elliptical aperture through which the electron beam propagates. The major axis 74 of elliptical electrode element 64 is aligned with the vertical Y-axis and is of greater length than the inner diameter 75 of mesh element 66. The minor axis 76 of elliptical electrode element 64 is aligned with the horizontal X-axis and is of a length at least equal to the diameter of mesh element 66. Four spring contacts 78 attached to the periphery of elliptical electrode element 64 engage and provide an electrical connection to a conductive wall coating 80 on the inner surface of ceramic funnel 16 (FIG. I). A DC voltage source or biasing means applies a potential difference of between +12 and +18 kilovolts between elliptical electrode element 64 and mesh electrode structure 62, which receives a potential of approximately zero volts. The potential applied to mesh electrode structure 62 is approximately equal to the average potential applied to deflection assembly 44.

Since major axis 74 and minor axis 76 of elliptical electrode element 64 are oriented in the vertical direction and horizontal direction, respectively, the separation between the periphery of elliptical electrode element 64 and that of mesh element 66 is greater in the vertical direction than in the horizontal direction. The potential difference between elliptical electrode element 64 and mesh element 66 creates, therefore, lensing action which is stronger in the horizontal direction than in the vertical direction. As a result, lens system 10 increases the angle of deflection in the horizontal direction by a greater amount than that in the vertical direction.

The lengths of major axis 74 and minor axis 76 are selected in accordance with, and provide scan expansion which is matched to, the deflection sensitivities in the respective vertical and horizontal directions. The scan expansion provided by lens system 10 is selected in accordance with various design objectives associated with CRT 12 such as, for example, the size of display screen 22, the relative power output capabilities of the horizontal and vertical deflection amplifiers, the overall length of the CRT, image brightness, and the beam image spot size. Since it is divergent in both the horizontal and vertical directions, lens system 10 exhibits a relatively weak lensing action and thereby employs electric fields which exhibit relatively gentle variations. As a result, the scan expansion performance of lens system 10 is relatively insensitive to small variations in the positioning of mesh element 66 and elliptical electrode element 64.

As was described above, elliptical electrode element 64 is biased at a potential of between +12 and +18 kilovolts relative to the potential applied to mesh electrode structure 62 to provide positive acceleration and scan expansion which is divergent in the horizontal and vertical directions. To provide negative acceleration and scan expansion, elliptical electrode element 64 would be biased at a potential of between −1500 and −1000 volts relative to the potential applied to mesh electrode structure 62. Under these conditions, lens system 10 would provide scan expansion that is overconvergent in both the horizontal and vertical directions. Although it would not employ and have the benefits of a relatively weak lensing action, such a negative bias on elliptical electrode element 64 would provide an acceleration and scan expansion lens which has independently selectable negative acceleration and scan expansion in the horizontal and vertical directions.

With particular reference to FIG. 3, support cylinder 70 has a length 82 of 3 centimeters and an outer diameter 84 of 2.54 centimeters. Retaining ring 68 has a length 86 of 2.03 centimeters and an outer diameter 88 of 3.3 centimeters. Support cylinder 70 and retaining ring 68 are positioned to have a combined length 90 of 4.32 centimeters. Mesh element 66 has an annular rim 92 which extends around the periphery of its open end and which fits between support cylinder 70 and retaining ring 68 to hold mesh element 66 in place. Mesh element 66 is substantially a hyperboloid of revolution and has a depth 94 of 0.510 centimeter along a line measured from the plane defined by its rim 92 to its apex 96. The effective diameter 75 (FIG. 4) of rim 92 of mesh element 66, which is defined by the inner diameter of retaining ring 68, equals 2.79 centimeters.

The upstream end of elliptical electrode element 64 is aligned with apex 96 of mesh element 66. Elliptical electrode element 64 has a length 100 of 0.762 centimeter. Major axis 74 has a length of 4.19 centimeters, and minor axis 76 has a length of 2.79 centimeters (FIG. 4).

A lens system 10 of the above-described dimensions allows the construction of a CRT 12 having a full-size display screen 22 of about 8 centimeters by 10 centimeters and an overall length 105 (FIG. 1) of about 36.1 centimeters.

Figure 5:
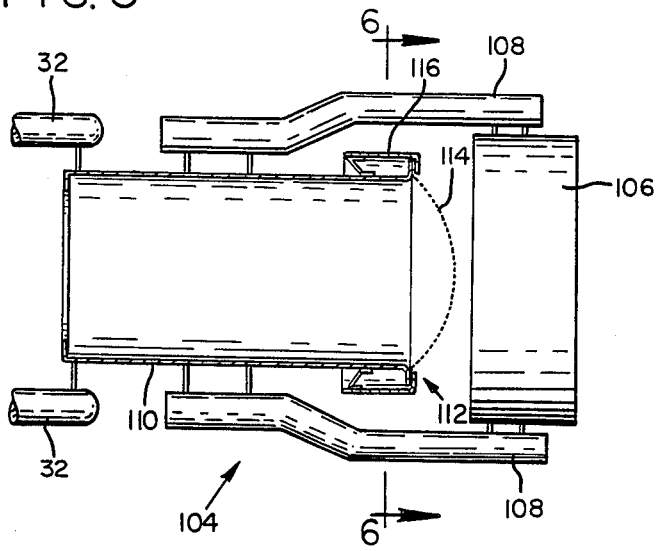
FIG. 5 is a schematic plan view of an alternative support structure, shown partly in cross section, for the elliptical electrode element of the lens system of FIG. 1.
Figure 6:
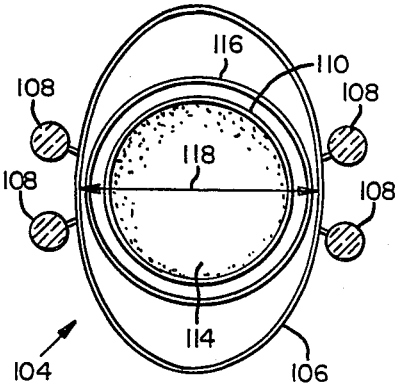
FIG. 6 is a vertical sectional view taken along lines 6—6 of FIG. 5.

FIGS. 5 and 6 show an alternative mounting structure for an electron beam acceleration and scan expansion lens system 104 of the present invention which operates in a manner similar to that of lens system 10. FIG. 5 is a schematic plan view of lens system 104 which includes a short length tubular electrode element 106 having an elliptical aperture supported by four glass rods 108 that are attached to a support cylinder 110 of mesh electrode structure 112. Lens system 104 differs from lens system 10 in that the support structure for elliptical electrode element 64 of lens system 10 employs glass rods 72 which are attached to retaining ring 68. Mesh electrode structure 112 is, however, supported by glass rods 32 that are attached to support cylinder 110 in a manner similar to that described with reference to mesh electrode structure 62 in FIGS. 1 and 3;

FIG. 6 is a vertical sectional view of lens system 104 that includes a dome-shaped mesh element 114 that is secured between a retaining ring 116 and the downstream end of support cylinder 110. Retaining ring 116 is supported on the downstream end of support cylinder 110 and has a diameter which is less than the length of the minor axis 118 of elliptical electrode element 106. This alternative mounting structure is advantageous because mesh electrode structure 112 can be loaded through elliptical electrode element 106 with relative ease during the assembly of lens system 104. The manner and principles of operation of lens system 104 are the same as those described above for lens system 10.

Figure 7:
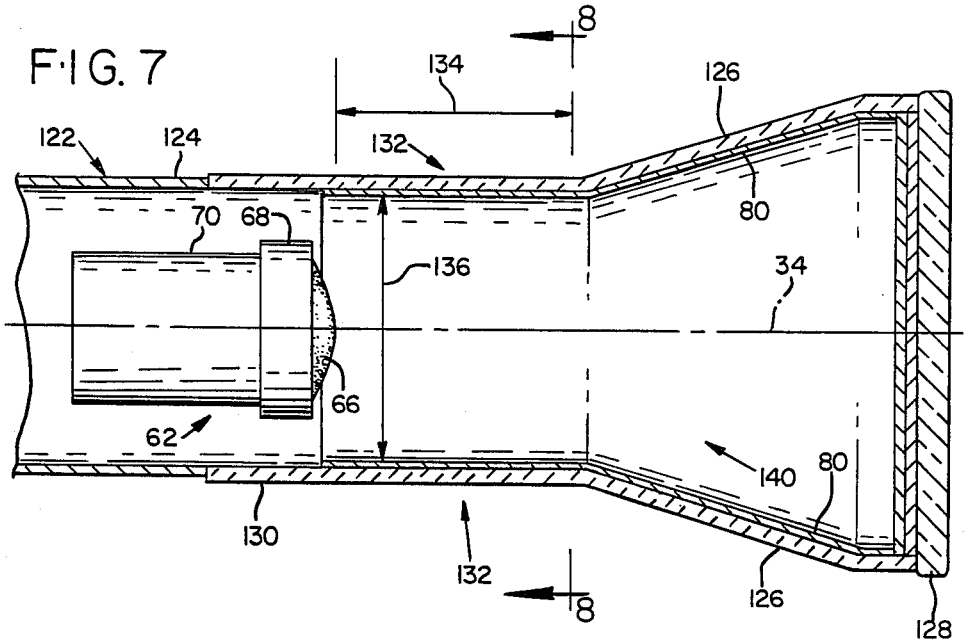
FIG. 7 is a schematic fragmentary longitudinal sectional view of a CRT incorporating a second preferred embodiment of the post-deflection acceleration and scan expansion lens system of the present invention.
Figure 8:
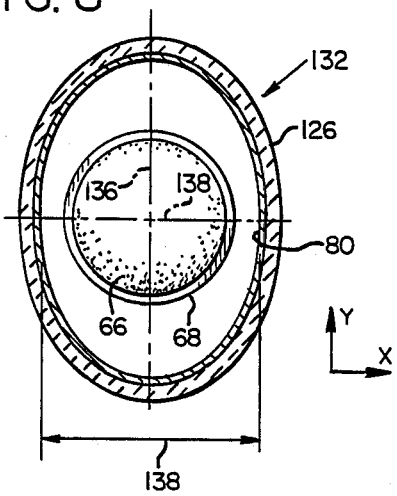
FIG. 8 is a vertical sectional view taken along lines 8—8 of FIG. 7.

FIGS. 7 and 8 are schematic diagrams that show a portion of a CRT 122 that comprises a second preferred embodiment of the acceleration and scan expansion lens of the present invention. The evacuated envelope of CRT 122 comprises a glass neck 124, a ceramic funnel 126, and a transparent glass face plate 128 which are sealed together as described above. Glass neck 124 is of rotationally symmetric shape as viewed in the X-Y plane of the coordinate system defined in FIG. 2 and is connected to a rotationally symmetric portion 130 of funnel 126. Funnel 126 is formed to include a portion 132 of elliptical shape as viewed in the X-Y plane. Elliptical portion 132 has a length 134 of 3.8 centimeters, a major axis 136 which is aligned with the Y-axis, and a minor axis 138 which is aligned with the X-axis.

An electron beam acceleration and scan expansion lens system 140 comprises mesh electrode structure 62 having mesh element 66, retaining ring 68, and support cylinder 70 assembled in the manner described above with reference to lens system 10. The elliptical electrode element of lens system 140 comprises a conductive wall coating 80 on the inner surface of elliptically-shaped portion 132 of ceramic funnel 126.

Lens system 140 operates in a manner similar to and under the same principles as lens systems 10 and 104. The configuration of lens system 140 is advantageous, however, because it employs fewer lens components than do lens systems 10 and 104. In particular, lens system 140 employs conductive coating 80 on elliptically shaped portion 132 of funnel 126 as a substitute for discrete elliptical electrode elements 64 and 106 shown in FIGS. 1–6.

The separation between mesh electrode structure 62 and elliptical electrode portion 132 of lens system 140 in a direction transverse to beam axis 34 is typically greater than that between the mesh electrode structures and the elliptical electrode elements shown in FIGS. 1–6. As a consequence, for a given potential difference between the electrode elements, lens system 140 provides less deflection magnification than that provided by lens systems 10 and 104. It will be appreciated, however, that such greater separation between the electrode elements of lens system 140 also allows the application of a proportionally greater potential difference to such elements. The capability for applying a proportionally greater potential difference results from the greater electrical isolation afforded by the greater spatial separation between the electrode elements of lens system 140 and thereby increases the threshold voltage at which arcing between the electrode elements begins. Lens system 140 is capable, therefore, of providing deflection magnification which is comparable to that of lens system 10.

Figure 9A:
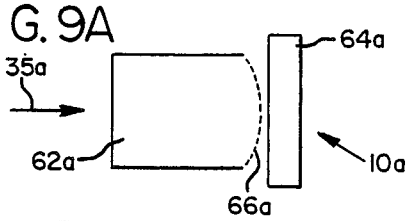
FIGS. 9A–9D are schematic side elevation views of alternative arrangements and configurations of the dome-shaped mesh element and the elliptical electrode element of the lens system of the present invention.
Figure 9B:
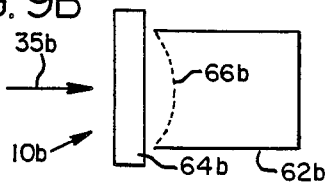
Figure 9C:
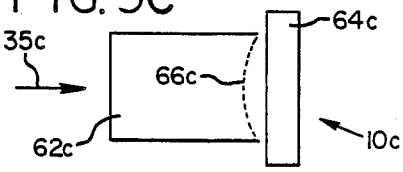
Figure 9D:
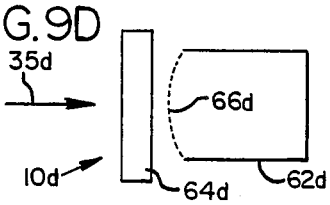

FIG. 9A is a schematic diagram showing for comparison purposes the arrangement of the electrode elements in the lens systems of FIGS. 1–4. FIGS. 9B–9D are schematic diagrams of alternative arrangements of the electrode elements of the acceleration and scan expansion lens system of this invention The. electrode elements in the arrangements shown in FIGS. 9B–9D are similar to the electrode elements shown in FIG. 9A. Corresponding electrode elements in FIGS. 9A–9D are identified, therefore, by identical reference numerals with the respective suffixes a–d.

FIG. 9A shows a lens system **10*a* that includes a mesh electrode structure 62*a* having a dome-shaped mesh element 66*a* which is concave as viewed in the direction 35*a* of electron beam propagation. Lens system 10*a* includes an elliptical electrode element 4*a* positioned adjacent the downstream end of mesh element 66*a*. As indicated above, mesh electrode structure 62*a* is typically biased at a potential which is approximately equal to the average potential applied to the deflection structures (i.e., bout zero volts). Positive acceleration and divergent scan expansion is provided by biasing elliptical electrode element 64*a* at a positive potential of between +12 and +18 kilovolts relative to the potential applied to mesh electrode structure 62*a*. Negative acceleration and over-convergent scan expansion is provided by applying a negative potential difference within the range −1500 to −1000 volts between elliptical electrode element 64*a* and mesh electrode structure 62*a***.

FIG. 9B shows a lens system **10*b* through which an electron beam propagates in direction 35*b*. Lens system 10*b* includes a mesh electrode structure 62*b* which is positioned adjacent the downstream end of an elliptical electrode element 64*b*. Mesh electrode structure 62*b* has a rotationally symmetric dome-shaped mesh element 66*b* which is concave as viewed in direction 35*b*. Elliptical electrode element 64*b* is positioned at the upstream end of lens system 10*b* and receives a potential of about zero volts. Whenever mesh electrode structure 62*b* is biased at a potential of between +12 and +18 kilovolts relative to the potential applied to elliptical electrode element 64*b*, lens system 10*b* provides positive acceleration and divergent scan expansion. Whenever a negative potential difference of −1500 to −1000 volts is applied between elliptical electrode element 64*b* and mesh electrode structure 62*b*, lens system 10*b* provides negative acceleration and over-convergent scan expansion. Lens system 10*b* is, therefore, an alternative to lens system 10*a***.

FIG. 9C shows a lens system 10c that includes a mesh electrode structure 62c having a dome-shaped mesh element 66c which is convex as viewed in the direction 35c of electron beam propagation. Lens system 10c includes an elliptical electrode element 64c positioned adjacent the downstream end of mesh electrode structure 62c. Mesh electrode structure 62c receives a potential of about zero volts.

The convex orientation of mesh element 66c causes the operating characteristics of lens system 10c to be complementary to the operating characteristics of lens system 10a. In particular, elliptical electrode element 64c is biased at a negative potential of between −1500 and −1000 volts so that lens system 10 c provides negative electron beam acceleration with divergent scan expansion. Positive acceleration with over-convergent scan expansion takes place whenever a potential difference of 14 to 16 kilovolts is applied between elliptical electrode element 64c and mesh electrode structure 62c.

FIG. 9D shows a lens system 10d through which an electron beam propagates in direction 35d. Lens system 10d includes a mesh electrode structure 62d which is positioned adjacent the downstream end of an elliptical electrode element 64d. Mesh electrode structure 62d has a rotationally symmetric dome-shaped mesh element 66d which is convex as viewed in direction 35d; Since it is disposed at the upstream end of lens system 10d, elliptical electrode structure 64d receives a potential of about zero volts. Whenever mesh electrode structure 62d is biased at a potential of between −1500 and −1000 volts relative to the potential applied to elliptical electrode element 64d, lens system 10d provides negative acceleration and divergent scan expansion. Conversely, whenever the potential difference between elliptical electrode element 64d and mesh electrode structure 62d is between about +12 and +18 kilovolts, lens system 10d provides positive electron beam acceleration and overconvergent scan expansion. Lens system 10d is, therefore, an alternative to lens system 10c.

Figure 10:
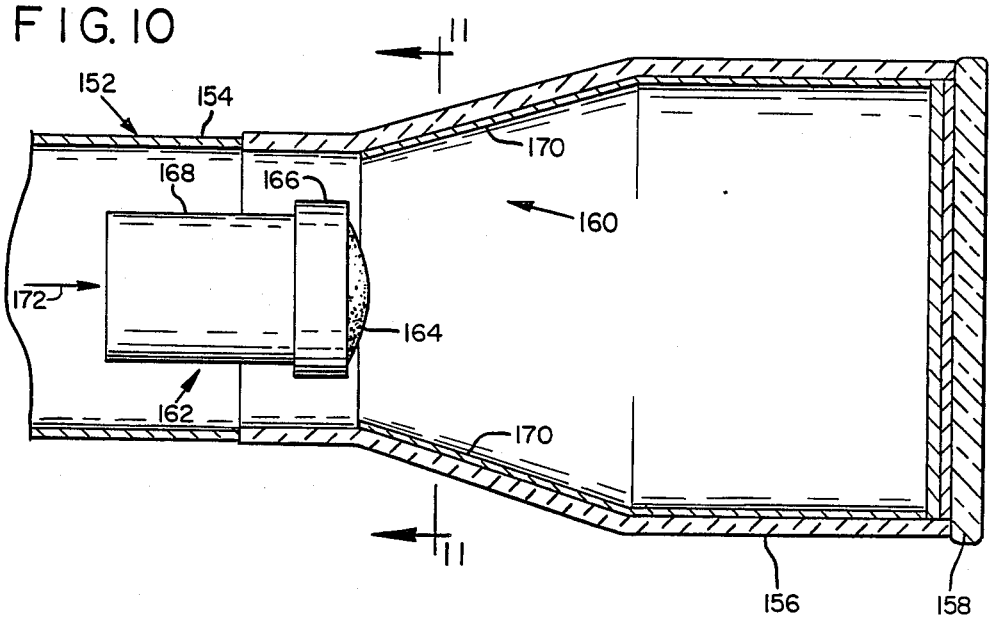
FIG. 10 is a schematic fragmentary longitudinal sectional view of a portion of a CRT incorporating a third preferred embodiment of the post-deflection acceleration and scan expansion lens system of the present invention.
Figure 11:
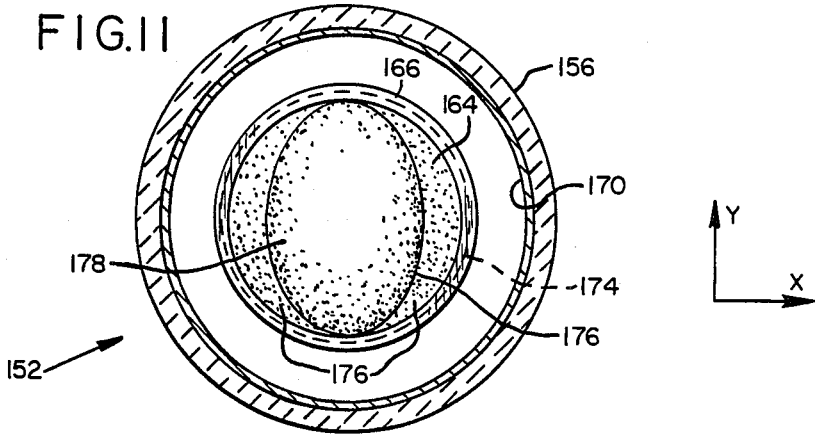
FIG. 11 is a vertical sectional view taken along lines 11—11 of FIG. 10.

FIGS. 10 and 11 are schematic diagrams that show a portion of a CRT 152 that comprises a third preferred embodiment of the acceleration and scan expansion lens of the present invention. The evacuated envelope of CRT 152 comprises a glass neck 154, a ceramic funnel 156, and a transparent glass face plate 158 which are sealed together as described above. Glass neck 154 and funnel 156 are each of rotationally symmetric shape as viewed in the X-Y plane of the coordinate system defined in FIG. 2.

An electron beam acceleration and scan expansion lens system 160 comprises a mesh electrode structure 162 having a mesh element 164, a retaining ring 166, and a support cylinder 168 assembled in the manner described above with reference to lens system 10. The tubular electrode element of lens system 160 comprises a conductive wall coating 170 on the inner surface of ceramic funnel 156.

As viewed in the direction 172 of electron beam propagation, mesh element 164 has an annular base 174 (shown in phantom) that supports two opposed flat meniscus mesh portions 176 on the inner diameter thereof. A concave portion 178 of elliptical crosssection in the X-Y plane depends from flat meniscus portions 176. Only the concave portion 178 affects the beam electrons in accordance with the present invention. Lens system 160 employs the conductive coating 170 on the inner surface of ceramic funnel 156 as a rotationally symmetric tubular electrode element. Lens system 160 is similar to lens system 140 of FIGS. 7 and 8 in that lens system 160 employs a conductive layer on the inner surface of a funnel as a substitute for a discrete electrode element. Lens systems 140 and 160 operate in a similar manner and exhibit similar performance characteristics.

It will be obvious to those having skill in the art that many changes may be made in the above-described details of the preferred embodiments of the present invention without departing from the underlying principles thereof. For example, the major and minor axes of the elliptical electrode element could be aligned with the respective horizontal and vertical directions. The scope of the present invention should be determined, therefore, only by the following claims.

We claim:

1. In an electron discharge tube having a deflection structure that deflects an electron beam with first and second deflection sensitivities in respective first and second nonparallel directions transverse to a beam axis, an acceleration and scan expansion lens positioned between the deflection structure and a target structure such that the electron beam exiting the deflection structure propagates along the beam axis through the lens and toward the target structure, the lens comprising:

a tubular electrode element positioned adjacent a mesh electrode structure that includes a dome-shaped mesh element, different ones of the tubular electrode element and the dome-shaped mesh element being of rotationally symmetric shape and of elliptical shape in a plane aligned transversely of the beam axis, the elliptical shape being defined by major and minor axes that are aligned with and whose lengths correspond to the deflection sensitivities in the first and second directions; and biasing means for applying between the mesh electrode structure and the tubular electrode element a potential difference that cooperates with the lengths of the major and minor axes to provide in the first and second directions electron beam acceleration and deflection magnification components corresponding to the first and second deflection sensitivities.

2. The lens of claim 1 in which the mesh electrode structure is positioned upstream of the tubular electrode element.

3. The lens of claim 2 in which the dome-shaped mesh element is of rotationally symmetric shape and the tubular electrode element has an aperture of elliptical shape.

4. The lens of claim 3 in which the dome-shaped mesh element is of concave shape as viewed in a direction downstream of the deflection structure.

5. The lens of claim 3 in which the dome-shaped mesh element is of convex shape as viewed in a direction downstream of the deflection structure.

6. The lens of claim 2 in which the electron discharge tube comprises a funnel portion which has an electrically conductive inner wall coating and which comprises the tubular electrode element, the tubular electrode element having an aperture of elliptical shape and the dome-shaped mesh element being of rotationally symmetric shape.

7. The lens of claim 2 in which the electron discharge tube comprises a funnel portion which has an electrically conductive inner wall coating and which comprises the tubular electrode element, the tubular electrode element having an aperture of rotationally symmetric shape and the dome-shaped mesh element being of elliptical shape.

8. The lens of claim 1 in which the mesh electrode structure is positioned downstream of the tubular electrode element.

9. The lens of claim 8 in which the dome-shaped mesh element is of rotationally symmetric concave shape as viewed in a direction downstream of the deflection structure and the tubular electrode element has an aperture of elliptical shape.

10. The lens of claim 8 in which the dome-shaped mesh element is of rotationally symmetric convex shape as viewed in a direction downstream of the deflection structure and the tubular electrode element has an aperture of elliptical shape.

11. A cathode-ray tube, comprising:

beam emitting means positioned near one end of the tube for directing an electron beam along a beam axis in the tube toward a display screen positioned near the other end of the tube;

deflecting means positioned along the beam axis for deflecting the electron beam with first and second deflection sensitivities in respective first and second nonparallel directions transverse to the beam axis;

an acceleration and scan expansion lens structure positioned between the deflecting means and the display screen, the lens structure including a tubular electrode element positioned adjacent a mesh electrode structure having a dome-shaped mesh element, different ones of the tubular electrode element and the dome-shaped mesh element being of rotationally symmetric shape and of elliptical shape in a plane aligned transversely of the beam axis, the elliptical shape being defined by major and minor axes that are aligned with and whose lengths correspond to the deflection sensitivities in the first and second directions; and biasing means for applying between the mesh electrode structure and the tubular electrode element a potential difference that cooperates with the lengths of the major and minor axes to provide in the first and second directions electron beam acceleration and deflection magnification components corresponding to the first and second deflection sensitivities.

12. The tube of claim 11 in which the mesh electrode structure is positioned upstream of the tubular electrode element.

13. The tube of claim 12 in which the mesh element is of rotationally symmetric shape and the tubular electrode element has an aperture of elliptical shape.

14. The tube of claim 12 in which the biasing means biases the mesh electrode structure at a negative potential relative to the tubular electrode element, thereby to provide positive electron beam acceleration.

15. The lens of claim 11 in which the dome-shaped mesh element is of concave shape as viewed in a direction downstream of the deflection structure.

* * * * *